United States Patent [19]

Nozawa

[11] 4,264,038

[45] Apr. 28, 1981

[54] MANUALLY OPERATIVE ATOMIZER

[75] Inventor: Takamitsu Nozawa, Tokyo, Japan

[73] Assignee: Yoshino Kogyosho Co., Ltd., Tokyo, Japan

[21] Appl. No.: 35,945

[22] Filed: May 4, 1979

Related U.S. Application Data

[62] Division of Ser. No. 949,757, Oct. 10, 1978, Pat. No. 4,185,776, which is a division of Ser. No. 782,888, Mar. 30, 1977, Pat. No. 4,132,359.

[30] Foreign Application Priority Data

| | | | |
|---|---|---|---|
| Apr. 9, 1976 | [JP] | Japan | 51-44649 |
| Apr. 9, 1976 | [JP] | Japan | 51-44650 |
| Apr. 13, 1976 | [JP] | Japan | 51-45761 |
| May 31, 1976 | [JP] | Japan | 51-70146 |

[51] Int. Cl.[3] ..... B05B 9/04

[52] U.S. Cl. ..... 239/333; 222/321; 222/402.13

[58] Field of Search ..... 239/331, 333, 337, 579; 222/321, 324, 340, 385, 402.13, 402.15

[56] References Cited

U.S. PATENT DOCUMENTS

| | | | |
|---|---|---|---|
| 3,007,613 | 11/1961 | Tugard | 222/402.15 |
| 3,137,885 | 6/1964 | Hulsh | 239/579 X |
| 3,409,186 | 11/1968 | Melocchi | 222/402.13 |
| 3,858,762 | 1/1975 | Meshberg | 222/402.13 X |
| 3,987,942 | 10/1976 | Morane et al. | 222/402.15 |

*Primary Examiner*—Robert W. Saifer

[57] ABSTRACT

A manually operative atomizer in which a liquid is sucked and pressurized by an atomizer means and is then atomized through a nozzle port. A chamber for pressurizing the liquid is constituted by a cylinder, while an atomizer head is connected to communication pipe which plays also the role of a piston, and is biased in the direction reverse to the pressurizing direction, by means of a spring. The atomizer head is provided with a guiding member adapted to be pressed and moved by an inclined surface of the operation member, so that the atomizer head and the piston or the jetting pipe are moved in the pressurizing direction. As the operation member is released from the depressing force, the spring moves the member back to its original position. Portions of the periphery of the atomizer head other than the nozzle port and the operating portion of the operating member are covered by a cap.

5 Claims, 12 Drawing Figures

MANUALLY OPERATIVE ATOMIZER

This is a divisional application of U.S. Application Ser. No. 949,757 filed Oct. 10, 1978, now U.S. Pat. No. 4,185,776, which in turn is a divisional application of U.S. Application Ser. No. 782,888 filed Mar. 30, 1977, now U.S. Pat. No. 4,132,359.

BACKGROUND OF THE INVENTION

Conventionally, atomizers have been used widely.

However, these atomizers have a drawback that the propellant gases used therein may affect the human body adversely or may explode.

For this reason, so-called manually operative compact sized atomizers are now under reconsideration. However, in the conventional manually operative atomizer, it is difficult to obtain a sufficient atomizing pressure especially at the beginning of the atomization, so that a fine atomization cannot be obtained at the beginning period.

In order to avoid this problem, the present applicant has proposed an atomizer of accumulator type, as in the U.S. Pat. No. 3,908,870 by the present Applicant. This accumulator type atomizer has a discharge valve adapted to remain closed until a sufficiently high pressure is established. Thus, the discharge valve does not immediately open at the beginning of the depression of the atomizer head, rather it is allowed to open only after the required pressure is established, so as to provide a fine atomization.

Although this accumulator type atomizer provides a practical solution to the above mentioned problem, another problem has arisen namely a considerably large force is required for depressing the atomizer head to overcome the force applied to the discharge valve in such atomizers.

The large depression force on the atomizer head is also necessary in other types of atomizers in addition to that of the accumulator type, especially when the amount of spray at one operation is quite large.

Since the handiness and easiness in the atomization operation is an important feature of atomizers, an exceedingly large force must not be required for the depression of the atomizing head.

SUMMARY OF THE INVENTION

The present invention is aimed at facilitating the depression of the atomizer head especially in the accumulator type atomizer. However, the invention is effectively applicable also to atomizers of types other than the accumulator type having a large amount of spray at one time of operation.

More specifically, according to the invention, an inclined surface is provided on an operation member to press and move the atomizer head, so as to enable the later to be moved with a reduced force.

According to another aspect of the invention, there is provided an atomizer having a cap for protecting the atomizer head from dust or other contaminants, wherein the atomization is performed easily without requiring the removal of the cap during the atomization.

Still another object of the invention resides in providing an atomizer in which an operation section is located remote from the nozzle port, so as to protect the operator's hands from the contents which may be a noxious chemical substance.

A further object of the invention is to provide an atomizer having a specific operation member which, however, does not hinder the packing of the atomizer for the purpose of transportation.

DESCRIPTION OF PREFERRED EMBODIMENTS

Figure 1:
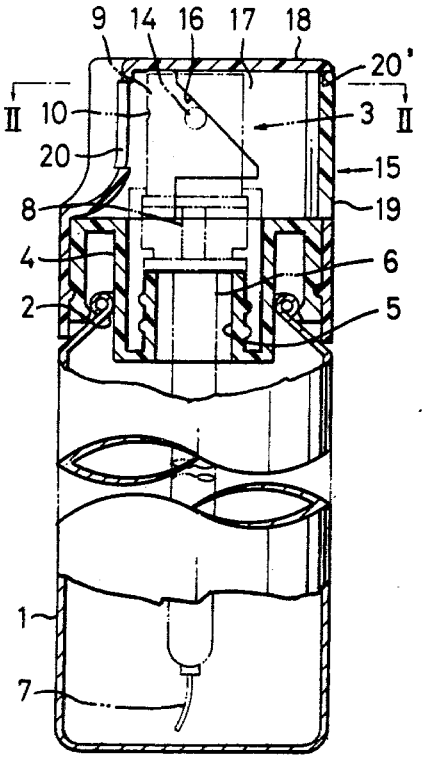
FIG. 1 is vertical sectional view of a manually operative atomizer.
Figure 2:
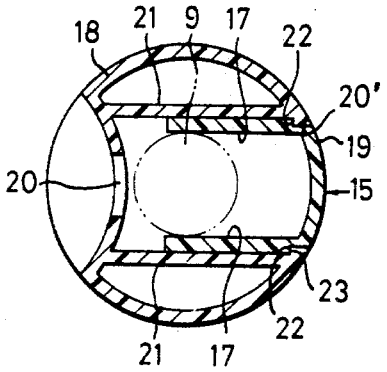
FIG. 2 is a sectional view taken along the line II—II of FIG. 1.
Figure 3:
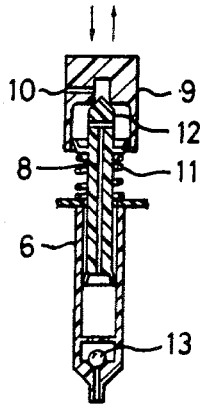
FIG. 3 is a sectional view of an essential part of the atomizer of FIG. 1, for explaining the manner of operation of an atomizer head of the later.

Referring at first to FIGS. 1 to 3 showing a first embodiment of the present invention, a manually operative atomizer has a container 1 for a liquid such as a chemical agent or the like to be atomized.

An atomizing assembly 3 of manually-depressed accumulation type is detachably secured to an opening 2 of the container 1.

A supporting frame 4 for the atomizer assembly 3 is adapted to be received by the opening 2. A cylinder 6 is provided passing through a cylindrical section 5 of the frame 4.

The lower end of the cylinder 6 is adapted for sucking the liquid from the container 1, through a pipe 7, while the upper end thereof is fixed to the cylindrical section 5 of the supporting frame 4.

After the liquid is drawn or sucked into cylinder 6, a check valve 13 prevents it from flowing back through pipe 7 to the liquid storage region of container 1.

A communication pipe 8, adapted to play also the role of a piston, is disposed to extend to upper portion of the cylinder 6. The upper portion of the communication pipe 8 is connected to an atomizer head 9. The atomizer head is provided with a nozzle port 10 through which the liquid pressurized within the cylinder 6 is atomized.

The atomizing function will now be explained in more detail with reference to FIG. 3.

The communication pipe 8 or pipe playing the double function of communication and piston is biased upwardly, i.e. in the direction opposite to that which it is depressed when pressurizing the liquid in cylinder 6. Accordingly, atomizer head 9 is biased upwardly also. Atomizer head 9 may be provided with a lower lip or rib which interacts with a collar, as is shown in FIG. 1, to properly position head 9 atop pipe 8.

As the atomizer head 9 is depressed downwardly, resisting to the biasing force of the spring 11, the communication pipe 8 is urged down along the cylinder 6 so that the liquid within the cylinder is pressurized.

When the pressure of the liquid exceeds a predetermined pressure, a discharge valve 12 is opened to allow an atomization through the nozzle port 10 as is more thoroughly described in U.S. Pat. No. 3,908,870, valve 12 opens when the differential pressure acting on the piston end of pipe 8 in cylinder 6 and the other piston end of pipe 8 in head 9 overcomes the pressure exerted by spring 11.

As the atomizer head is released from the depressing force, the spring 11 moves the atomizer head 9 and the communication pipe 8 upwardly, during which the liquid is sucked into the cylinder 6 through a non-return valve 13.

An explanation will be made here as to an essential feature of the invention. Assuming that the surface of the atomizer head 9 in which the nozzle port 10 is formed is the "front" surface, guide pins 14 are formed at both side surfaces of the atomizer head 9. The pins 14 are adapted to cause the downward movement of the atomizer head 9, upon being depressed by an operation member 15. An inclined surface 16 for depressing the pins 14 is provided on a pair of the side plates 17 which are parallel with each other and are fastened to the body of the operation member 15.

The inclined surface 16 has a length larger than the stroke, i.e. the distance of downward movement, of the atomizing head 9.

A cap 18 is fixed to the frame 4, and is adapted to guide the operation member 15.

The cap 18 has notches or openings 20,20' at its front portion confronting the nozzle port 10 and at its back portion, respectively, so that the operating section 19 at the back side of the cap may be manually operated.

At the inside of the cap 18, there is provided a pair of guide plates 21 adapted for guiding the pair of the side plates 17 of the operation member 15, when the later moves in the transverse direction as viewed in FIG. 1.

In this state, the operation member 15 is guided, also at its top and bottom surfaces, by the ceiling of the cap 18 and by the upper surface of the frame, respectively.

At the same time, the side wall of the cap 18 adjacent to the nozzle port 10 is recessed so that an opening formed in that wall is located close to the nozzle port, so as not to disturb the atomization.

A step 22 is formed in the peripheral edge of the operating section 19 of the operation member 15 to prevent it from dropping out. A stopper 23 for engaging the step 22 is provided in an opening 20' which constitutes a root portion for a pair of guiding plates 21.

The cap can be easily applied to common or ordinary atomizers, if the cap 18 is formed to be detachable from the frame 4.

In use, the operation section 19 of the operation member 15 is simply pressed so that the guide pins 14 are forced down in accordance with the travel distance of the inclined surface 16 of the side plates 17.

Consequently, the atomizer head 9 is depressed, along with the comminication pipe 8 playing the role of the piston, so as to effect an atomization through the nozzle port 10, as aforementioned.

When the depression on the operation section 19 is stopped, the atomizing head 9 is moved upwardly by the biasing force exerted by the spring 11, so that the guide pins 14 press the inclined surface 16 of the side plates 17 to bring the operation member 15 back to its initial position.

The atomization is performed by repeating above described process.

As has been explained, since the atomizer head is depressed by a long displacement of the inclined surface, the atomizer head can be depressed with a smaller force, as compared with the direct depression in the prior arts, eusuring a smooth operation.

The atomizer of the invention is advantageous also from a view point of health, because the hand on the operating member remote from the nozzle port is less likely to be contaminated by the atomized liquid.

In addition, the atomization can conveniently be perfomed, without removing the cap.

In addition, since there is no projecting portion in the state for storage, in spite of a provision of a specific operation member, no problem is caused in the storage and transportation.

Figure 4:
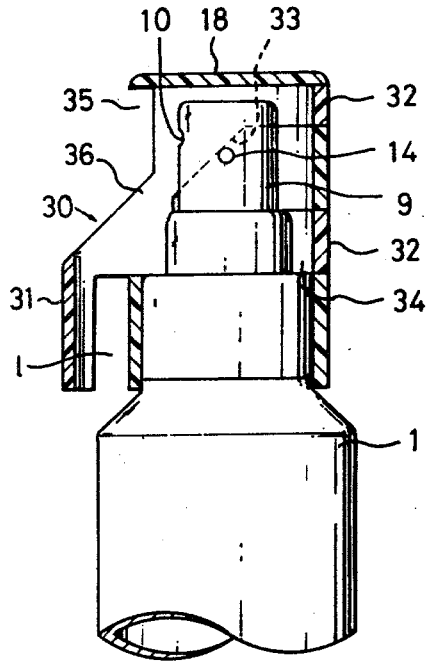
FIG. 4 is a partial sectional view of another embodiment of the invention.
Figure 5:
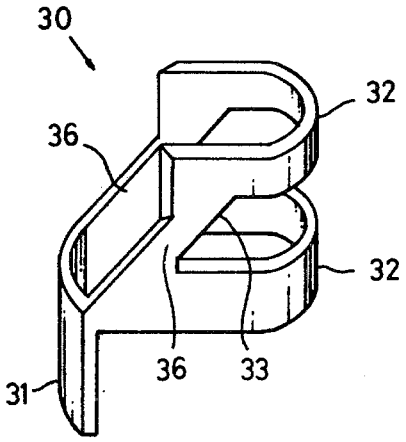
FIG. 5 is a perspective view of an operation member in the atomizer of FIG. 4.
Figure 6:
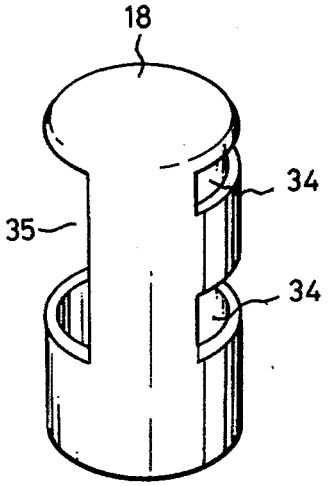
FIG. 6 is a perspective view of a cap playing also the role of a guide, for the operation member of FIG. 5.

Referring now to FIGS. 4 to 6 showing a second embodiment of the invention, an operation member 30 is provided with a trigger section 31 for facilitating the atomizing operation.

The operating member 30 is generally cylindrical, and the trigger section 31 is provided at the lower end of the front (i.e. the side in which the nozzle port is provided) wall of the cylindrical main body.

In order to guide the lateral movement of the operation member 30 as viewed in FIG. 4, guide sections 32 are provided at the upper and the lower portions of the main body.

At the same time, a cam plate 36 constituting an inclined surface 33 is provided between the two guide sections 32.

The cap 18 in this embodiment is provided with guide ports 34 for guiding the lateral movements of two guide sections 32, the cap covering the atomizer head 9. The cap 18 is further provided with an opening 35 at a position corresponding to the atomizer nozzle 9 and the operation section of the operation member 30.

A distance l is preserved between the trigger member 31 and the cap 18, in correspondence with the travel or stroke of the operation member 30.

Therefore, as the trigger section 31 is operated, the operation member 30 is moved rightwardly, as viewed in FIG. 4, with the guiding sections 32 being guided by the guiding ports 34. Then, the guide pins at respective sides of the atomizer head 9 are depressed by the inclined surface 33 of the cam plate 36 to cause the atomization.

The construction of other parts than described and the effects are substantially same with those of the first embodiment, but the operation is considerably facilitated by the provision of the trigger section.

Figure 7:
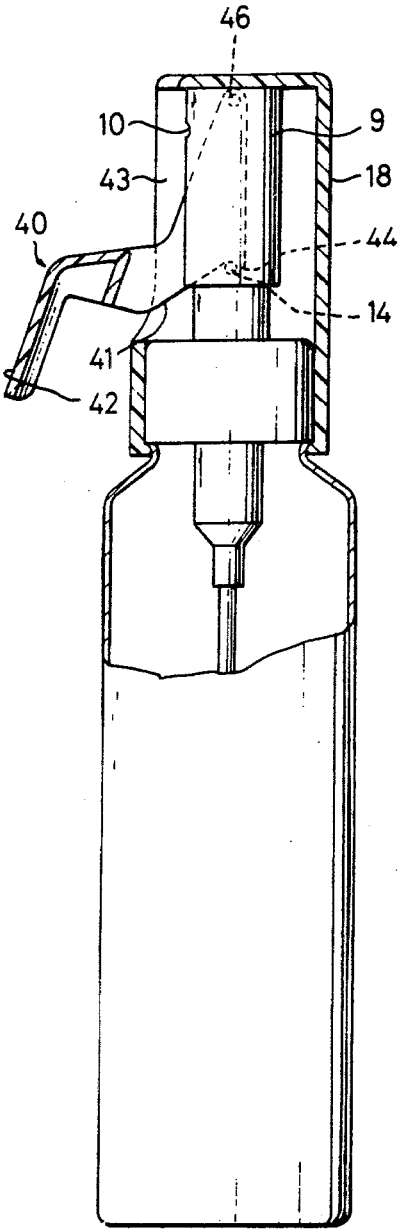
FIGS. 7 and 8 are partial sectional views showing the manners of operation of manually operative atomizers constituting a third embodiment of the invention.
Figure 8:
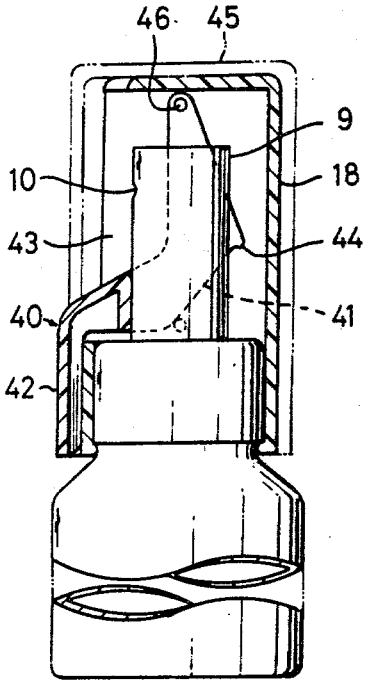
Figure 9:
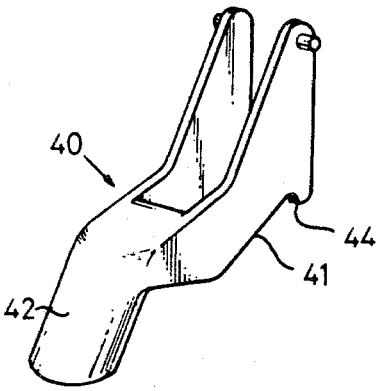
FIG. 9 is a perspective view of an operating member of FIG. 7.

Referring now to FIGS. 7 to 9 showing a third embodiment of the invention, an atomization is performed, making use of an inclined cam surface 41, by a swinging motion of the operation member 40.

The operation member 40 is formed in the form of U, with the atomizer head 9 interposed between its two legs, and is suspended pivotally, as denoted by 46, from the ceiling of the cap 18 for free swinging motion.

The operation member 40 has an inclined cam surface 41 at its forked portion, which cooperates with the guide pins 14 at respective sides of the atomizer head 9 for depressing the later 9.

A trigger section 42 is provided at the external end of the operation member 40, and is adapted to be projected through an opening 43 of the front wall (i.e. at the side in which the nozzle port 10 is provided) of the cap 18.

A stopper 44 is formed at the inner end portion of the cam surface 41, to limit the movement of the operation member 40.

When there is no depressing force on the operation member 40, the atomizer head 9 is biased upwardly to raise the trigger section 42. However, this does not cause a substantial problem in handling and fowardling, if an outer cover 45 or an outer cap is used in combination with the cap 18, as shown in FIG. 8.

The outer cover 45 then may be provided with a slit for exposing the front surface of the trigger section 42.

In operation, as the trigger section 42 of the operation member 40 is depressed, the atomization is easily performed. Construction and manner of operation other than described are same with those of the first embodiment.

An equivelent effect to that of the first embodiment is ensured, if the outer case is used only during the transportation, as well as a further simplified construction.

Figure 10:
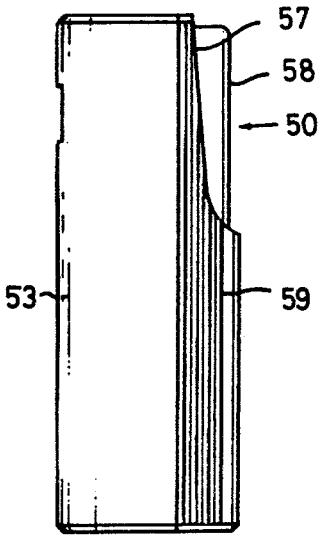
FIG. 10 is a side elevational view of a manually operative atomizer which constitutes a fourth embodiment of the invention.
Figure 11:
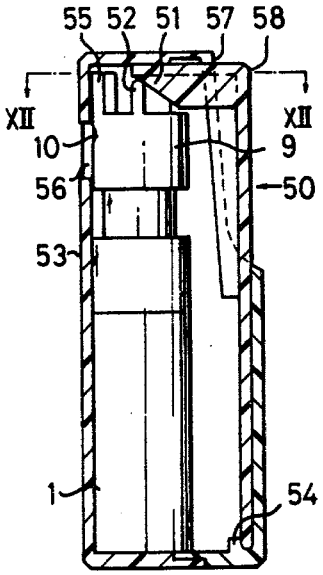
FIG. 11 is an elevational sectional view of the atomizer of FIG. 10.
Figure 12:
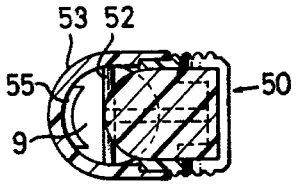
FIG. 12 is a sectional view taken along the line XII—XII of FIG. 11.

A fourth embodiment will be described with reference to FIGS. 10 through 12.

This fourth embodiment is constructed such that a swinging motion of the operation member 50 having at its end an inclined surface 51 causes a depression of the atomizer head 9, through an engagement with the inclined surface 51 with a guiding projection 52 formed on the atomizer head 9.

The operation member 50 is generally L-shaped and is provided with the inclined surface 51 at its one end confronting the atomizer head 9.

The operation member 50 is supported at its other end by the corner of the bottom of the cap case 53 covering the atomizer head 9 and the container 1, and is held at its lower end by an engaging member 54. The operation member 50 is adapted to be rotated around its lower end supported by the engaging member 54.

A guiding projection 52 adapted to be depressed by the inclined surface 51 is formed on the atomizer head 9, while a guide plate 55 is provided at the upper position of the nozzle port 10.

The guide plate 55 is adapted to slide on the inner wall of the cap case 53, when the atomizer head is depressed, to guide the depression.

An opening 56 is formed in the wall of the case 53 at a position corresponding to the nozzle port 10 at the upper portion of the front wall, while another opening 57 is formed at an upper portion of the rear wall of the case.

Frictioning projections or protrusions 59 are formed on the outer surface of the cap case 53.

In operation, the atomizing can be effected quite easily, by simply depressing the operation section 58 of the operation member 50.

The construction of chief parts and the manner of operation are materially identical to those of the first embodiment but can provide a specific portability.

As has been described, in the atomizer in accordance with the invention, the atomizing operation can be made quite easily by a provision of an inclined surface formed in an operation member, which cooperates with the atomizing head to depress the later with a reduced manual force.

In addition, since the removal of the dust-protecting cap covering the atomizer head is unnecessary for the atomizing, the work is rendered much simpler.

It will be understood that the foregoing objects are all fulfilled by the present invention.

What is claimed is:

1. In a manually operable atomizer of the type having a container for containing liquid and an atomizer assembly connected to said container for atomizing the liquid, the atomizer assembly including a cylinder, a piston slidable in said cylinder, an atomizer head having a nozzle port therein, a pipe connecting and allowing communication between said piston and said atomizer heads, and a spring biasing said atomizer head in a first direction, movement of said atomizer head in a direction opposite said first direction causing compression of liquid in said cylinder, forcing the liquid through said pipe and out through said nozzle port, the improvement comprising:

a guiding member on said atomizer head;

an operating member for depressing said guiding member against the biasing of said spring, said operating member including an inclined surface engaging said guiding member; and a casing covering said atomizer assembly, said container and said operating member, said casing having openings therein for allowing access to said operating member and to allow passage of the atomized liquid, an upper end of said operating member being slidably mounted in said casing for movement in a direction substantially perpendicular to said first direction, a lower end of said operating member being pivotally mounted in said casing.

2. The manually operated atomizer as claimed in claim 1, wherein said operating member is generally formed in the shape of the letter L.

3. The manually operable atomizer as claimed in claim 1, wherein the operating member shields the opening for said operating member.

4. The manually operated atomizer according to claims 1 or 3, wherein said operating member is at least partially disposed in the opening for said operating member.

5. The manually operable atomizer as claimed in claim 1, wherein said atomizer head includes a guide plate, said guide plate sliding on an inner wall of said casing in response to the depression of said atomizer head.

* * * * *